US010487789B2

(12) United States Patent
Money

(10) Patent No.: US 10,487,789 B2
(45) Date of Patent: Nov. 26, 2019

(54) ENGINE STARTING VIA ELECTRIC TURBOCHARGER

(71) Applicant: Ford Global Technologies, LLC, Dearborn, MI (US)

(72) Inventor: Eric Money, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 28 days.

(21) Appl. No.: 15/851,637

(22) Filed: Dec. 21, 2017

(65) Prior Publication Data

US 2019/0195185 A1 Jun. 27, 2019

(51) Int. Cl.

| | |
|---|---|
| ***F02N 9/04*** | (2006.01) |
| ***F02D 41/06*** | (2006.01) |
| *F02B 39/10* | (2006.01) |
| *F02D 41/26* | (2006.01) |

(52) U.S. Cl.

CPC ..... *F02N 9/04* (2013.01); *F02D 41/062* (2013.01); *F02B 39/10* (2013.01); *F02D 41/26* (2013.01)

(58) Field of Classification Search

CPC ..... F02N 9/04; F02D 41/062; F02D 41/26; F02B 39/10

See application file for complete search history.

(56) References Cited

U.S. PATENT DOCUMENTS 4,022,164 A * 5/1977 Fuchs ..... F02B 75/12 123/179.3
5,114,769 A * 5/1992 Kani ..... B29C 70/025 188/251 A
5,323,743 A * 6/1994 Kristiansson ..... F02N 11/04 123/179.28
5,458,098 A * 10/1995 Yagi ..... F02N 11/08 123/179.3
5,460,138 A * 10/1995 Hasegawa ..... F02B 77/00 123/179.3
6,182,449 B1 2/2001 Halimi et al.
7,681,545 B2 * 3/2010 Taki ..... F02N 11/0844 123/179.3
8,036,815 B2 * 10/2011 Okumoto ..... F02N 11/0844 701/110
8,109,092 B2 2/2012 Pursifull et al.
8,355,860 B2 * 1/2013 Liu ..... F02N 11/087 123/179.4
8,360,182 B2 * 1/2013 Schneider ..... B60W 10/06 180/65.28
8,413,635 B2 * 4/2013 Machida ..... F02N 11/0844 123/179.3
8,606,450 B2 * 12/2013 Holmes ..... B60W 20/00 701/22
9,022,001 B2 * 5/2015 Shafto ..... F02N 11/106 123/179.3

(Continued)

*Primary Examiner* — Joseph J Dallo

(74) *Attorney, Agent, or Firm* — Geoffrey Brumbaugh; McCoy Russell LLP

(57) ABSTRACT

Methods and systems are provided for starting an engine via an electric turbocharger. In one example, a method for starting the engine via the electric turbocharger may include flowing compressed air from the electric turbocharger to cylinders of the engine to crank a crankshaft of the engine without a starter motor. The method may include adjusting an opening amount of electrically or pneumatically actuated intake valves and exhaust valves to reduce a force to crank the crankshaft.

20 Claims, 6 Drawing Sheets

(56) References Cited

U.S. PATENT DOCUMENTS

| | | | | |
|---|---|---|---|---|
| 9,163,604 | B2 * | 10/2015 | Odahara | F02N 15/00 |
| 9,249,750 | B2 * | 2/2016 | Santoso | F02D 41/009 |
| 9,316,197 | B2 * | 4/2016 | Rangger | F02N 7/08 |
| 9,322,352 | B2 * | 4/2016 | Santoso | F02D 41/042 |
| 9,631,596 | B2 * | 4/2017 | Kitano | F02D 41/0097 |
| 9,726,134 | B2 * | 8/2017 | Okabe | F02N 11/0844 |
| 10,099,675 | B2 * | 10/2018 | Shafto | B60W 10/04 |
| 2003/0140881 | A1 * | 7/2003 | Makajima | F02B 61/02 123/179.3 |
| 2007/0084429 | A1 * | 4/2007 | Taki | F02N 11/0844 123/179.4 |

* cited by examiner

ENGINE STARTING VIA ELECTRIC TURBOCHARGER

FIELD

The present description relates generally to methods and systems for controlling an electric turbocharger to start an internal combustion engine of a vehicle.

BACKGROUND/SUMMARY

Engine systems often include a starter motor configured to rotate a crankshaft of the engine prior to combustion of fuel and air within engine cylinders. The starter motor provides the engine with an initial source of torque in order to transition the engine from rest to an operational mode in which the engine combusts fuel and air to rotate the crankshaft. However, a starter motor may increase a cost and/or weight of the engine system.

Attempts to address reducing the cost and weight of the starter motor include reducing a size of the starter motor and/or a number of components included by the starter motor, and/or adjusting engine parameters to reduce starter motor load. One example approach is shown by Halimi et al. in U.S. Pat. No. 6,182,449. Therein, a two-cycle internal combustion engine is disclosed including a motor-assisted turbocharger that provides charge air for running the engine. The motor-assisted turbocharger may be arranged in series with an exhaust-driven turbocharger, and during startup, the motor-assisted turbocharger may provide charge air to the engine. When sufficient air pressure is available from a compressor of the motor-assisted turbocharger, the engine is cranked over by a starting motor.

However, the inventors herein have recognized potential issues with such systems. As one example, starting of the engine in such systems may be dependent on both of the motor-assisted turbocharger and the starting motor. During conditions in which the compressor of the motor-assisted turbocharger is unable to deliver sufficient air pressure, the starter motor may be unable to supply enough energy to start the engine. Similarly, during conditions in which the starter motor experiences degradation or power loss, the engine may be unable to start.

In one example, the issues described above may be addressed by a method for an engine, comprising: during an engine start request, driving a crankshaft of the engine without combustion only by flowing compressed air from an electric turbocharger to cylinders of the engine and without actuating a starter motor. In this way, the crankshaft may be rotated via only the compressed air prior to combustion of fuel and air in engine cylinders in order to start the engine.

As one example, the engine may include electrically or pneumatically actuated intake valves and exhaust valves, and the amount of opening of the intake valves and exhaust valves may be adjusted by a controller of the engine during engine startup. The controller may adjust the amount of opening of the intake valves and exhaust valves in order to decrease an amount of force delivered by the pressurized air to move pistons disposed within the engine cylinders and to rotate the crankshaft. In this way, the engine may be cranked without a starter motor, and a cost and weight of the engine may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
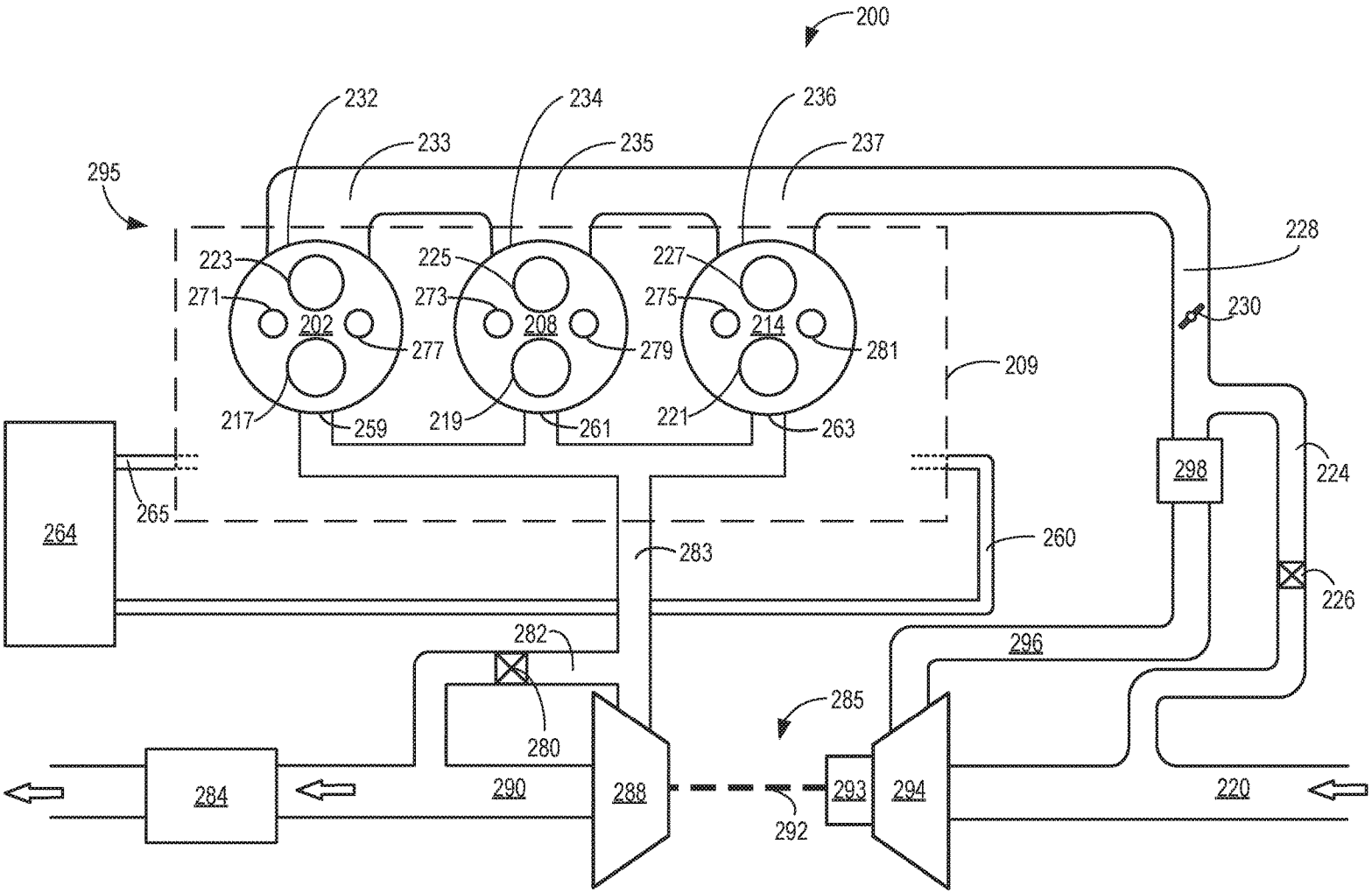
FIG. 2 schematically shows an engine system including a plurality of cylinders, with each cylinder configured to receive compressed air from an electric turbocharger.
Figure 3:
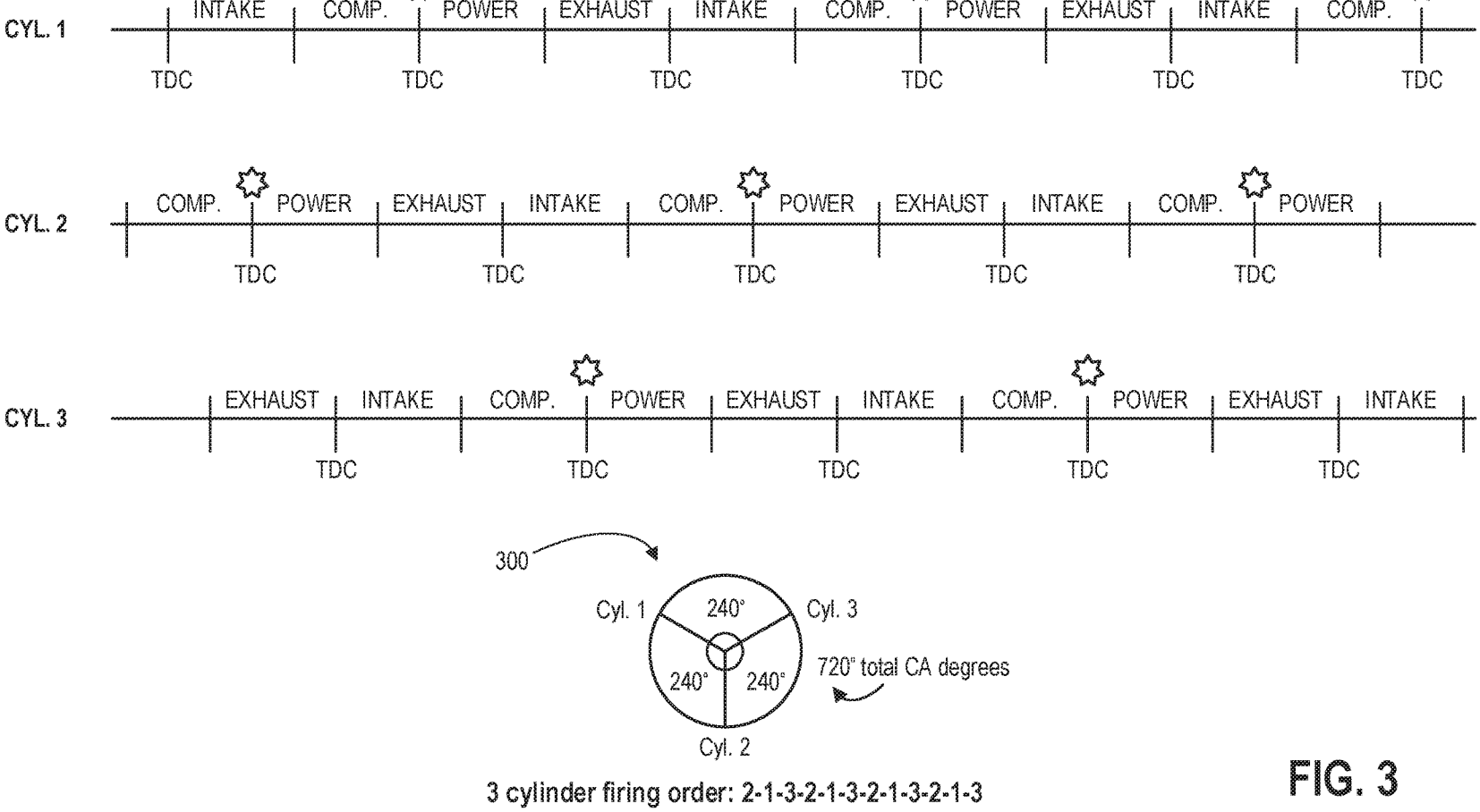
FIG. 3 shows an ignition timing and combustion cycle of an engine including three cylinders.
Figure 4:
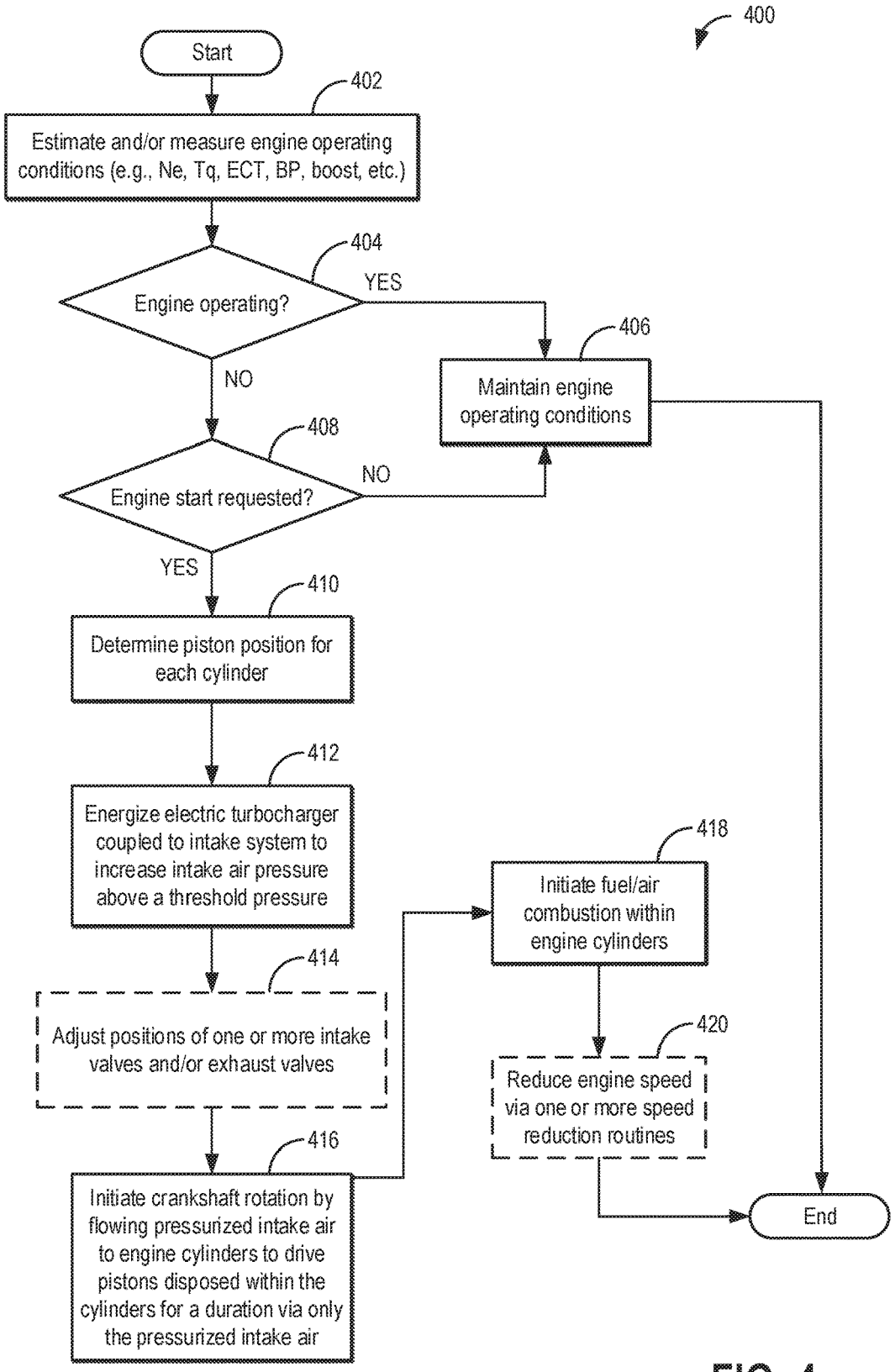
FIG. 4 illustrates a method for starting an engine by flowing compressed air to engine cylinders via an electric turbocharger.
Figure 5:
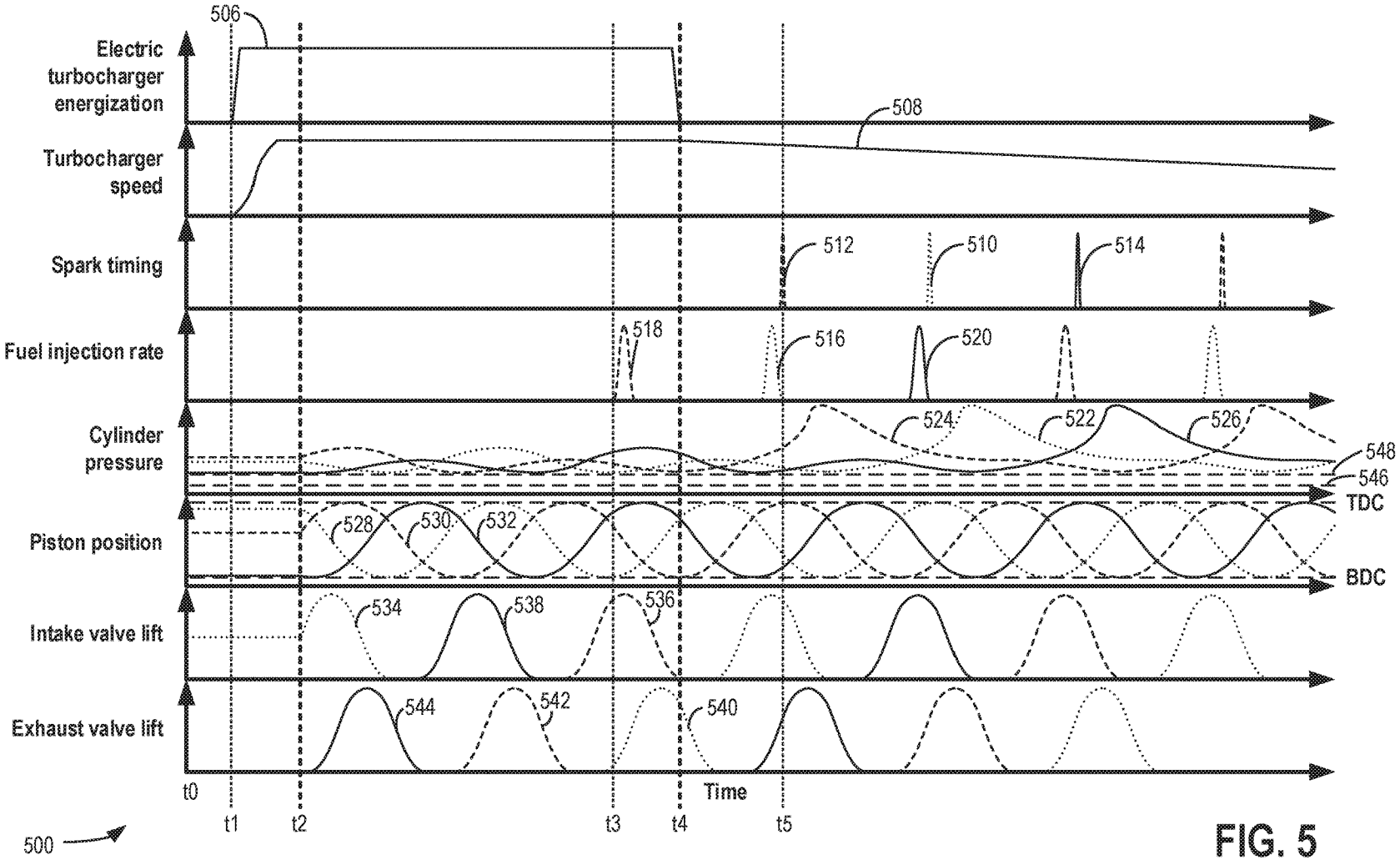
FIG. 5 shows a graph illustrating engine operating parameters for an engine including mechanically-actuated intake valves and exhaust valves during an engine starting operation via an electric turbocharger.
Figure 6:
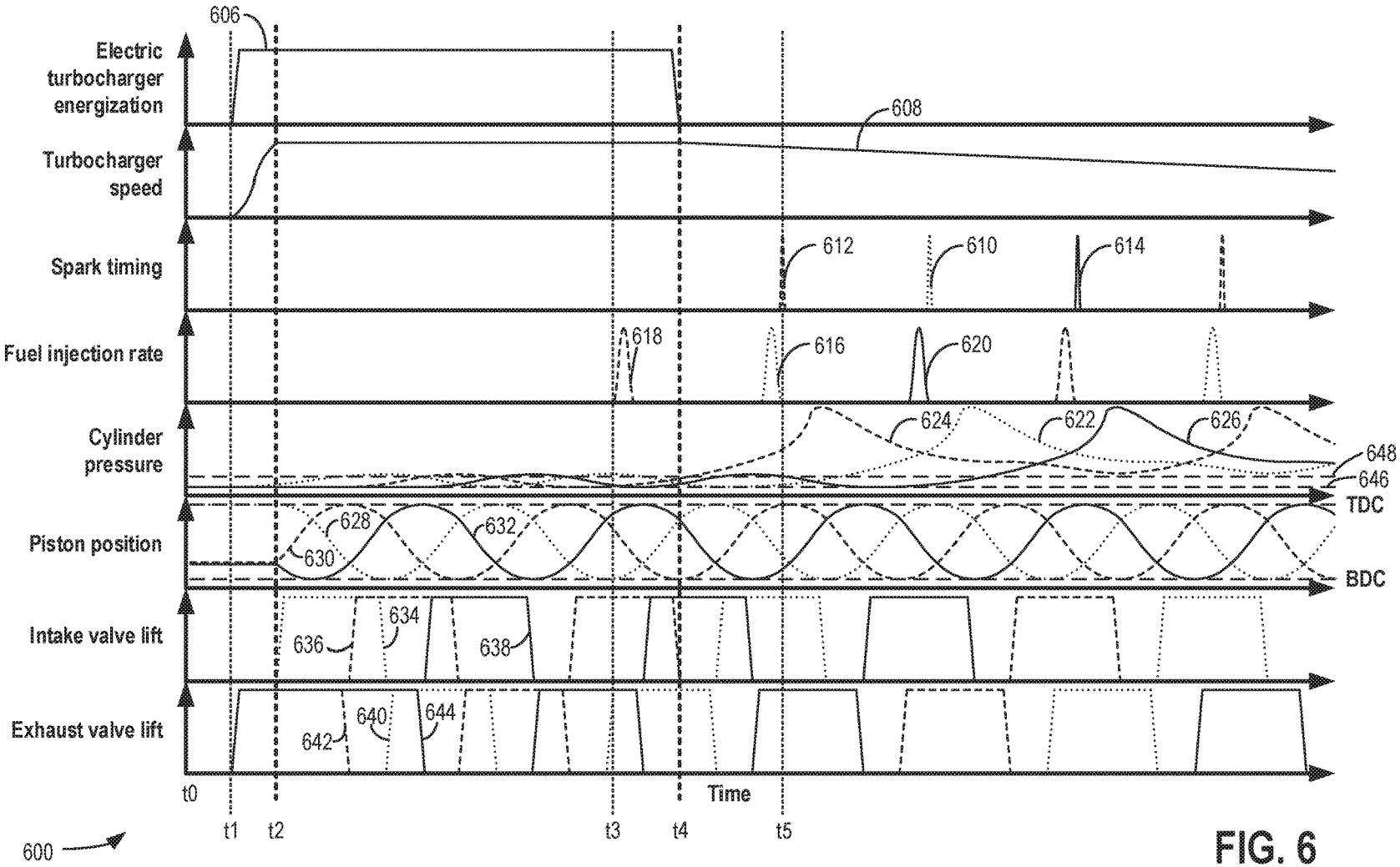
FIG. 6 shows a graph illustrating engine operating parameters for an engine including intake valves and exhaust valves actuated without cams during an engine starting operation via an electric turbocharger.

The following description relates to systems and methods for controlling an electric turbocharger to start an internal combustion engine of a vehicle. A vehicle, such as the vehicle shown by FIG. 1, includes an internal combustion engine having a plurality of combustion chambers. In some examples, the engine may include three cylinders, as shown by FIG. 2. The cylinders of the engine may have a 2-1-3 cylinder firing order, as shown in FIG. 3. During conditions in which the engine is at rest, an operator of the engine may indicate that an engine start event is desired (e.g., may initiate an engine start request). As shown by FIG. 4, in response to the engine start request, an electric turbocharger of the engine may be energized in order to flow compressed intake air to engine cylinders to drive pistons disposed within the cylinders. The pistons may be driven by the compressed air for a duration until a crankshaft of the engine reaches a threshold speed or threshold number of rotations, at which point a controller of the engine may initiate combustion of fuel and air within the engine cylinders to maintain operation of the engine. In some examples, as shown by FIG. 5, the engine may include mechanically actuated intake valves and exhaust valves, with pressurized intake air flowing into cylinders having intake valves in an opened position at engine startup. In other examples, as shown by FIG. 6, the engine may include electrically or pneumatically actuated intake valves and exhaust valves adjustable by the controller. The controller may adjust an amount of opening of each intake valve and exhaust valve during engine startup in order to decrease an amount of force to drive the pistons during startup. In this way, the engine may be started from rest by compressed intake air from the electric turbocharger and without a starter motor.

Figure 1:
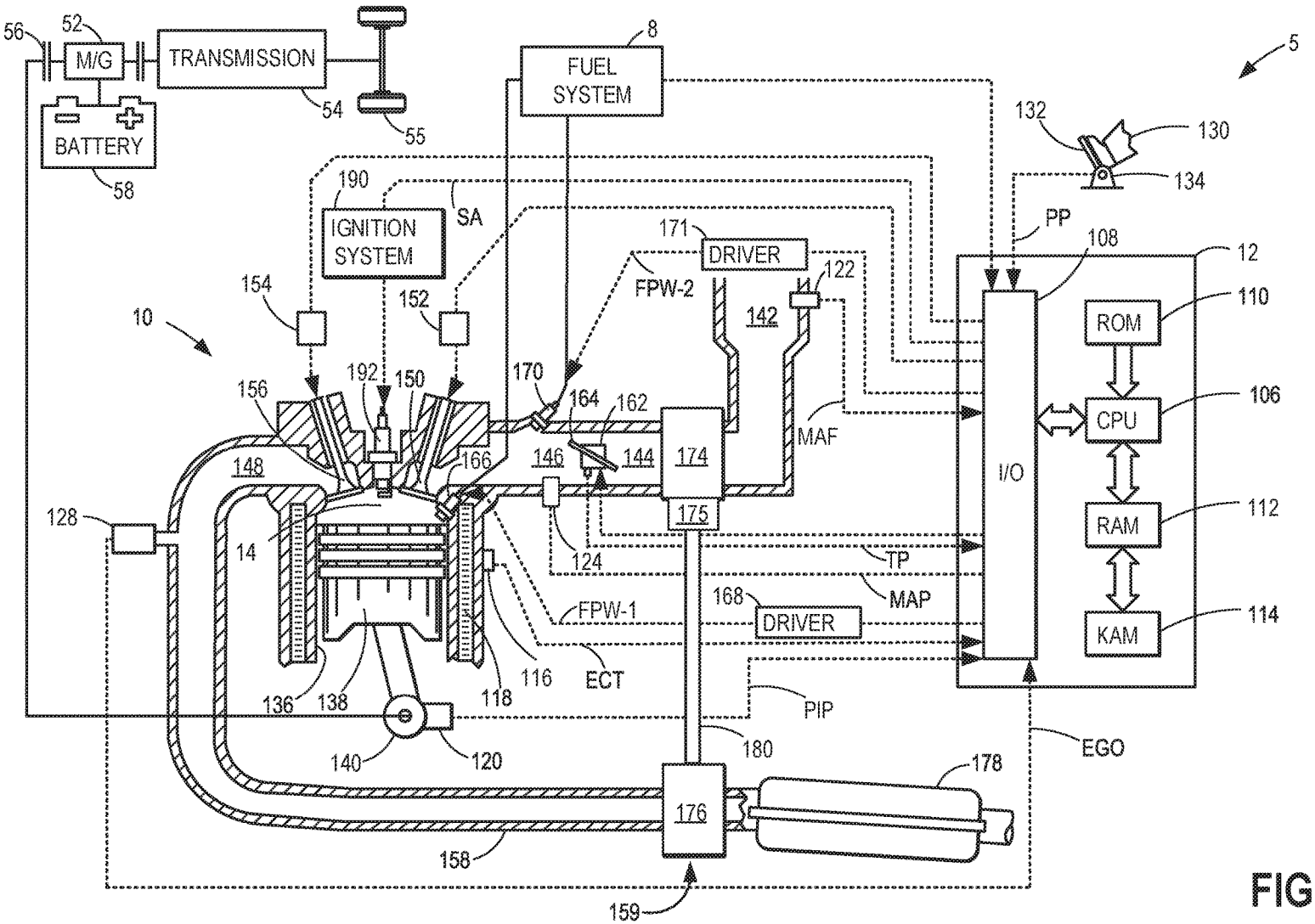
FIG. 1 schematically shows a cylinder of an internal combustion engine of a vehicle, the cylinder configured to receive compressed air from an electric turbocharger.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In the example shown by FIG. 1, the vehicle 5 includes an electric turbocharger 159. Electric turbocharger 159 is configured to deliver compressed intake air to each of the cylinders of the vehicle 5 (e.g., cylinder 14). FIG. 1 shows engine 10 configured with a compressor 174 of the electric turbocharger 159 arranged between intake passages 142 and 144, and an exhaust turbine 176 of the electric turbocharger 159 arranged along exhaust passage 148. Compressor 174 may be at least partially powered by exhaust turbine 176 via a shaft 180 during conditions in which the engine 10 is operating (e.g., the engine 10 is on, and fuel and air are combusted within one or more of the cylinders of the engine 10). However, in some examples, exhaust turbine 176 may be optionally omitted, and compressor 174 may be powered by mechanical input from a motor or the engine. As referred to herein, an electric turbocharger (e.g., electric turbocharger 159) includes at least a compressor configured to deliver compressed air to engine cylinders, and an electric motor (e.g., electric motor 175) configured to drive (e.g., spin) the compressor. The electric turbocharger may further include a turbine (e.g., exhaust turbine 176) configured to be driven by exhaust gases flowing out of the engine 10.

Electric turbocharger 159 includes electric motor 175 coupled to compressor 174. The compressor 174 may be referred to herein as an electrically driven air compressor. Electric motor 175 may be selectively energized by the controller 12 in order to spin the compressor 174 and deliver compressed intake air to the cylinders of the engine 10 (e.g., cylinder 14). For example, as described below with reference to FIG. 4, the electric motor 175 may be energized by the controller 12 in response to an engine start request (e.g., during the engine start request, while the engine 10 is off and is not combusting fuel/air in engine cylinders) in order to deliver compressed air to the engine cylinders to move pistons disposed within the cylinders (e.g., piston 138) and rotate the crankshaft 140 of the engine 10, without combusting fuel/air within engine cylinders. After moving the pistons via the compressed air, one or more of the engine cylinders may then be provided with fuel (e.g., gasoline, diesel, etc., via fuel injector 166 and/or fuel injector 170) and spark may be initiated within the one or more engine cylinders (e.g., via spark plug 192) to combust fuel/air within the engine cylinders and start the engine 10. Further examples are described below with reference to FIGS. 4-6.

A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

The controller 12 receives signals from the various sensors of FIG. 1 and employs the various actuators of FIG. 1 to adjust engine operation based on the received signals and instructions stored on a memory of the controller. For example, adjusting a flow of compressed air from the electric turbocharger 159 may include adjusting an actuator of the compressor 174 (e.g., electric motor 159) to adjust an output of the compressor 174 (e.g., an amount of compressed intake air flowing from the compressor 174 to engine cylinders). Further examples are described below with reference to FIGS. 4-6

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

FIG. 2 schematically shows an engine system 200 including an engine 295, similar to engine 10 described above with reference to FIG. 1. Engine system 200 includes several components similar to those described above with reference to FIG. 1. For example, engine system 200 includes intake passage 220, turbocharger 285 having compressor 294 coupled to electric motor 293, turbine 288 coupled to compressor 294 via shaft 292, throttle 230, exhaust passage 283, and emission control device 284, similar to intake passage 142, turbocharger 159 having compressor 174 coupled to electric motor 175, turbine 176 coupled to compressor 174 via shaft 180, throttle 162, exhaust passage 148, and emission control device 178, respectively, described above with reference to FIG. 1.

Further, engine system 200 includes a plurality of cylinders similar to the cylinder 14 described above with reference to FIG. 1, with the cylinders being in an inline configuration (e.g., with each cylinder positioned along a same axis) and disposed within a cylinder head 209 in the example shown by FIG. 2. Specifically, engine 295 of engine system 200 includes a first cylinder 202, a second cylinder 208, and a third cylinder 214. First cylinder 202 includes first intake valve 223, first exhaust valve 217, first fuel injector 271, and first spark plug 277, second cylinder 208 includes second intake valve 225, second exhaust valve 219, second fuel injector 273, and second spark plug 279, and third cylinder 214 includes third intake valve 227, third exhaust valve 221, third fuel injector 275, and third spark plug 281. Each of the intake valves (e.g., intake valves 223, 225, and 227) may be similar to intake valve 150, each of the exhaust valves (e.g., exhaust valves 217, 219, and 221) may be similar to exhaust valve 156, each of the fuel injectors (e.g., fuel injectors 271, 273, and 275) may be similar to fuel injector 166, and each of the spark plugs (e.g., spark plugs 277, 279, and 281) may be similar to spark plug 192, with intake valve 150, exhaust valve 156, fuel injector 166, and spark plug 192 being described above with reference to FIG. 1. Although the engine 295 includes three cylinders in the example shown by FIG. 2, in other examples the engine 295 may include a different number of cylinders (e.g., four, six, eight, ten, twelve, etc.), with each cylinder including a corresponding intake valve, exhaust valve, fuel injector, and spark plug. In some examples, each cylinder may include more than one intake valve and/or exhaust valve (e.g., two intake valves and two exhaust valves per cylinder).

Engine system 200 may additionally include one or more heat exchangers (e.g., radiator 264) configured to reduce a temperature of engine coolant (e.g., water) flowing through cylinder head 209. For example, FIG. 2 shows radiator 264 coupled to engine 295 via a first coolant passage 265 and a second coolant passage 260. Radiator 264 may be configured to receive coolant from the cylinder head 209 of the engine 295 via first coolant passage 265, and may cool the coolant via one or more heat exchanging elements (e.g., fins) of the radiator 264. Coolant that has been cooled by the radiator 264 may flow into the cylinder head 209 via the second coolant passage 260, such that the first coolant passage 265 and second coolant passage 260 form a coolant circuit between the radiator 264 and coolant passages disposed within an interior of the cylinder head 209.

The engine system 200 may further include boost passage 296 coupled to compressor 294 and configured to receive compressed air from compressor 294, and bypass passage 224 coupled to intake passage 220 with bypass valve 226 positioned therein. Boost passage 296 may additionally include one or more heat exchangers, such as charge air cooler 298, in order to reduce a temperature of the compressed air flowing through the boost passage 296 from compressor 294. In one example, an electronic controller of the engine system 200 (e.g., similar to controller 12 described above with reference to FIG. 1) may adjust an amount of opening of the bypass valve 226 in order to adjust a flow of intake air through both of boost passage 296 and bypass passage 224. For example, the controller may increase an amount of opening of the bypass valve 226 in order to increase a flow of intake air from intake passage 220 through the bypass passage 224 and/or to decrease a flow of intake air from intake passage 220 to the compressor 294. In another example, the controller may decrease the amount of opening of the bypass valve 226 in order to decrease the flow of intake air from intake passage 220 through the bypass passage 224 and/or to increase the flow of intake air from intake passage 220 to the compressor 294. Increasing and decreasing the amount of opening of the bypass valve 226 via the controller may include transmitting an electrical signal (e.g., electrical pulse) to the bypass valve 226 to adjust the amount of opening, with one or more parameters of the electrical signal (e.g., amplitude, pulse width, etc.) indicating the desired amount of opening. For example, an electrical signal having a longer, first pulse width may adjust the bypass valve 226 to a first amount of opening, and an electrical signal having a shorter, second width may adjust the bypass valve 226 to a second amount of opening, with the first amount of opening being a greater amount of opening than the second amount of opening.

Further, the amount of intake air flowing through boost passage 296 and/or bypass passage 224 may be additionally adjusted by adjusting an amount of opening of throttle 230.

In one example, the controller may increase or decrease the amount of opening of throttle 230 by transmitting electrical signals to an actuator of the throttle 230 (e.g., similar to the example adjustments described above with reference to bypass valve 226) to adjust a position of the throttle 230 (e.g., within intake passage 228). Throttle 230 may include a throttle plate and/or position sensor, similar to the throttle plate 164 and throttle position sensor described above with reference to FIG. 1, and the controller may receive signals from the throttle position sensor in order to determine the amount of opening of the throttle 230.

During conditions in which the throttle 230 is in an opened position (e.g., a position in which the throttle 230 is not fully closed), intake air may flow through the throttle 230 and into intake passage 228 fluidically coupled to intake junctions 233, 235, and 237. Each of the intake junctions fluidically couples the intake passage 228 to intake ports of the engine cylinders. For example, intake junction 233 fluidically couples intake passage 228 to intake port 232 of first cylinder 202, intake junction 235 fluidically couples intake passage 228 to intake port 234 of second cylinder 208, and intake junction 237 fluidically couples intake passage 228 to intake port 236 of third cylinder 214. Each of the intake ports (e.g., intake port 232, intake port 234, and intake port 236) is sealed by a corresponding intake valve (e.g., first intake valve 223, second intake valve 225, and third intake valve 227, respectively) during conditions in which the corresponding intake valve is in a fully closed position. The intake junctions 233, 235, and 237 may be referred to herein collectively as an intake manifold.

For example, during conditions in which first intake valve 223 is in a fully closed position, intake air within intake passage 228 and the intake junctions 233, 235, and 237 does not flow through the intake port 232 and into first cylinder 202. Similarly, during conditions in which second intake valve 225 is in the fully closed position, intake air within intake passage 228 and the intake junctions 233, 235, and 237 does not flow through the intake port 234 and into the second cylinder 208, and during conditions in which the third intake valve 227 is in the fully closed position, intake air within intake passage 228 and the intake junctions 233, 235, and 237 does not flow through the intake port 236 and into the third cylinder 214. However, during conditions in which the first intake valve 223 is in an opened position, intake air within the intake passage 228 and/or the intake junctions may flow into the first cylinder 202 via the intake port 232. Similarly, during conditions in which the second intake valve 225 is in an opened position, intake air may flow into the second cylinder 208 via the intake port 234, and during conditions in which the third intake valve 227 is in an opened position, intake air may flow into the third cylinder 214 via the intake port 236.

Intake air within intake passage 228 and the intake junctions 233, 235, and 237 may be at different pressures for different engine operating conditions. For example, during conditions in which compressor 294 is spinning to compress intake air, the compressed intake air has a higher pressure than atmospheric intake air (e.g., intake air flowing through intake passage 220 and bypass passage 224). In one example, the pressure of the compressed intake air flowing from the compressor 294 may be approximately 2.36 atm, and the pressure of intake air flowing through passage 220 and bypass passage 224 may be approximately 1 atm. During conditions in which intake air does not flow from bypass passage 224 into intake passage 228 (e.g., during conditions in which the bypass valve 226 is in the fully closed position), intake air may flow into the intake passage 228 only via the compressor 294. For example, during conditions in which the bypass valve is in the fully closed position, intake air flowing through intake passage 220 may be directed past bypass passage 224 and through the compressor 294, such that intake air flowing into the intake passage 228 is provided the compressor 294 and not the bypass passage 224. As a result, a pressure of the intake air within the intake passage 228 may be higher than atmospheric air pressure (e.g., 2.36 atm), and opening one or more of the intake valves (e.g., first intake valve 223) may flow the pressurized air into the corresponding cylinders coupled with the one or more intake valves (e.g., first cylinder 202).

The exhaust valves of each cylinder (e.g., first exhaust valve 217 of first cylinder 202, second exhaust valve 219 of second cylinder 208, and third exhaust valve 221 of third cylinder 214) fluidically couple the cylinders to exhaust passage 283. During conditions in which the exhaust valves are in an opened position (e.g., not a fully closed position), exhaust gases (e.g., uncombusted intake air, and/or combusted fuel and air) may flow out of the cylinders into the exhaust passage 283. For example, during conditions in which the first exhaust valve 217 is in an opened position, exhaust gases may flow out of the first cylinder 202 and into the exhaust passage 283 via a first exhaust port 259 of the first cylinder 202. During conditions in which the first exhaust valve 217 is in the fully closed position (e.g., a position in which the first exhaust valve 217 is seated against the first exhaust port 259), the first exhaust valve 217 seals the first exhaust port 259 such that exhaust gases do not flow from the first cylinder 202 to the exhaust passage 283. Similarly, the second exhaust valve 219 seals second exhaust port 261 in a similar way, and the third exhaust valve 221 seals third exhaust port 263 in a similar way.

In some examples, such as the example described below with reference to FIG. 5, the intake valves and exhaust valves may each be mechanically driven (e.g., driven by one or more rotating cams of one or more camshafts of the engine). In other examples, such as the example described below with reference to FIG. 6, the intake valves and exhaust valves may each be electrically driven (e.g., driven by one or more solenoids, with the solenoids being configured to receive electrical signals from the controller in order to adjust the amount of opening of the intake valves and exhaust valves) or pneumatically driven (e.g., driven by a pressure-responsive actuator).

Exhaust gases may flow from the cylinders through the exhaust passage 283 toward the turbine 288 and turbine bypass passage 278. Turbine bypass passage 282 may include a turbine bypass valve 280 disposed therein, with the turbine bypass valve 280 being adjustable to different amounts of opening (e.g., via electrical signals transmitted to an actuator of the bypass valve 280 via the controller, similar to bypass valve 226 described above) in order to control a flow of exhaust gases through the turbine bypass passage 282. For example, in order to increase a flow of exhaust gases from the cylinders to the turbine 288, the controller may transmit an electrical signal (e.g., electrical pulse) to the actuator of the turbine bypass valve 280 in order to decrease an amount of opening of the turbine bypass valve 280. Compressor 294 may be at least partially powered by turbine 288 via shaft 292 during conditions in which exhaust gases flow out of the cylinders and through the turbine 288, similar to the examples described above with reference to turbine 176 and compressor 174 shown by FIG. 1. In another example, in order to decrease the flow of exhaust gases from the cylinders to the turbine 288, the controller may transmit an electrical signal to the actuator of the turbine bypass valve 280 in order to increase the amount of opening of the turbine bypass valve 280. Exhaust gases flowing through the turbine bypass valve 280 and/or turbine 288 may flow through exhaust passage 290 toward emission control device 284, and out to atmosphere. Although not shown by FIG. 2, in some examples the engine system 200 may include a low-pressure (LP) or high-pressure (HP) exhaust gas recirculation (EGR) system in order to recirculate a portion of exhaust gases flowing out of the cylinders to one or more of the intake passages (e.g., intake passage 228).

FIG. 3 shows a cylinder firing order of an engine including three cylinders, such as the engine 295 described above with reference to FIG. 2 and/or the engine 10 described above with reference to FIG. 1. FIG. 3 depicts ignition timing diagrams for each of the three cylinders. It will be appreciated that cylinders 1, 2, and 3 in FIG. 3 may correspond to first cylinder 202, second cylinder 208, and third cylinder 214, respectively, of FIG. 2. For each diagram, cylinder number is shown on the y-axis and engine strokes are depicted on the x-axis. Further, ignition, and the corresponding combustion event, within each cylinder is represented by a star symbol between compression and power strokes within the cylinder. Further, additional diagram 300 portrays cylinder firing events in each cylinder around a circle representing 720 degrees of crank rotation.

In the example of FIG. 3, ignition and combustion events within the engine and between the three cylinders may occur at 240 CA (crank angle) degree intervals. Herein, firing events may occur at evenly spaced intervals. Likewise, each engine stroke within the three cylinders may occur at 240 CA degree intervals. For example, an exhaust stroke in cylinder 1 may be followed by an exhaust stroke in cylinder 2 at about 240 CA degrees after the exhaust stroke in cylinder 1. Similarly, the exhaust stroke in cylinder 2 may followed by an exhaust stroke in cylinder 3 after an interval of 240 CA degrees. Firing events in the engine may occur similarly. An example firing order for the three-cylinder engine may be 2-1-3-2-1-3. As illustrated at 300, cylinder 1 may be fired approximately 240 CA degrees after cylinder 2 is fired, cylinder 3 may be fired approximately 240 CA degrees after the firing event in cylinder 1, and cylinder 2 may be fired approximately 240 CA degrees after the firing event in cylinder 3. Thus, a method of operating an engine may comprise firing a second, first, and third cylinder of the three cylinders, each firing event separated by 240 degrees of crank angle (CA).

It will be appreciated that the even firing intervals of 240 CA degrees in the three-cylinder engine may be approximate. In one example, the firing interval between cylinder 3 and cylinder 2 may be 230 CA degrees. In another example, the firing interval between cylinder 3 and cylinder 2 may be 255 CA degrees. In yet another example, the firing interval between cylinder 3 and cylinder 2 may be exactly 240 CA degrees. Likewise, the firing interval between cylinder 2 and cylinder 1 may vary in a range between 230 CA degrees and 255 CA degrees. The same variation may apply to firing intervals between cylinder 1 and cylinder 3. Other variations may also be possible.

The cylinder configuration and firing order depicted in FIG. 3 describes the operation of a three-cylinder engine. In some examples, the firing order may be a different firing order, such as 1-2-3-1-2-3. In another example, the engine may include six cylinders arranged in two banks, with each bank possessing a grouping of three cylinders (e.g., V6 engine) where each grouping of three cylinders has the same configuration described above with reference to FIGS. 2-3. In the configuration having two banks with three cylinders each, the firing order may be 2-5-1-4-3-6, for example, with cylinders 1, 2, and 3 residing in one grouping, while cylinders 4, 5, and 6 reside in the other grouping. All of the advantages inherent to the methods described herein for a three-cylinder engine also apply to the example of the V6 engine. In yet another example, the engine may have six cylinders arranged inline (e.g., along a shared axis, as an I6 engine) as two groupings of three cylinders each, with each grouping of three cylinders possessing the same configuration described above with reference to FIGS. 2-3. In this configuration, the firing order may be 2-5-1-4-3-6, with cylinders 1, 2, and 3 residing in one grouping, while cylinders 4, 5, and 6 reside in the other grouping. All of the advantages inherent to the methods described herein for a three-cylinder engine (and six-cylinder V6 engine) also apply to the I6 engine. In yet another example, the engine may have twelve cylinders arranged in two banks of six cylinders each (e.g., V12 engine) where each bank of six cylinders has the same configuration described in the discussion of the I6 engine above (e.g., each bank of six cylinders includes two groupings of three cylinders each, and each grouping of three cylinders possesses the same configuration described above with reference to FIGS. 2-3). In this configuration the firing order may be 1-7-5-11-3-9-6-12-2-8-4-10, for example, with cylinders 1-6 residing in one bank, while cylinders 7-12 reside in the other bank. All of the advantages inherent to the methods described herein for a three-cylinder engine (and six-cylinder I6 and V6 engines) also apply to the example of the V12 engine. In yet other examples, the engine may have a different number of cylinders, such as four, eight, ten, etc., and all of the advantages inherent to the methods described herein also apply to these engine cylinder configurations.

FIG. 4 illustrates a method 400 for controlling an electric turbocharger of an engine to start the engine. In some examples, the electric turbocharger and engine may be the electric turbocharger 159 and engine 10 described above with reference to FIG. 1, or the electric turbocharger 285 and engine 295 described above with reference to FIG. 2. In one example, the engine may have a firing order similar to the firing order shown by FIG. 3 and described above. However, the firing order shown by FIG. 3 is one non-limiting example of a firing order that may be utilized with the method illustrated by FIG. 3, and other firing orders are possible. Additionally, method illustrated by FIG. 3 may apply to engines having a different number of cylinders (e.g., four, eight, etc.) and/or arrangement of cylinders (e.g., inline arrangement, multiple cylinder banks, etc.), as described above. Instructions for carrying out method 400 and the rest of the methods included herein may be executed by a controller (e.g., controller 12 shown by FIG. 1 and described above) based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 402, the method includes estimating and/or measuring engine operating conditions. For example, engine operating conditions may include engine speed, engine torque output, engine coolant temperature, vehicle speed, spark timing, barometric pressure, boost flow amount and/or boost pressure, fuel injection amount, crankshaft position, etc. The controller may estimate and/or measure the engine operating conditions based on signals transmitted to the controller by one or more sensors of the engine system. For example, the controller may receive signals (e.g., electrical signals) from a crankshaft position sensor (e.g., Hall effect sensor 120 shown by FIG. 1, or other type) in order to estimate and/or measure a position of the crankshaft (e.g., amount of rotation of the crankshaft relative to a reference position or initial position). In another example, the controller may receive signals (e.g., electrical signals) from an absolute manifold pressure sensor (e.g., sensor 124 shown by FIG. 1) in order to estimate and/or measure the absolute intake manifold pressure. In yet another example, the controller may receive signals from one or more mass air flow sensors (e.g., mass air flow sensor 122 shown by FIG. 1) positioned upstream and/or downstream of a compressor of the electric turbocharger (e.g., compressor 174 shown by FIG. 1, or compressor 294 shown by FIG. 2) in order to measure and/or estimate an amount of compressed air (from the compressor) and/or uncompressed air (from a bypass passage, such as bypass passage 224 shown by FIG. 2) flowing to engine cylinders (e.g., first cylinder 202, second cylinder 208, and/or third cylinder 214 shown by FIG. 2).

At 404, the method includes determining whether the engine is operating. In one example, the determination of whether the engine is operating may be based on the estimated and/or measured engine operating conditions at 402. For example, the controller may make the determination of whether the engine is operating based on control signals transmitted to the controller from the sensors of the engine (e.g., the sensors described above with reference to FIG. 1). In one example, the controller may determine whether the engine is operating based on the estimated and/or measured engine speed, engine torque output, vehicle speed, spark timing, fuel injection amount, and/or engine coolant temperature. For example, during conditions in which fuel is not being injected into engine cylinders and/or the engine is not producing torque, the controller may make a determination that the engine is not operating (e.g., fuel/air is not being combusted within engine cylinders). In another example, during conditions in which fuel is being injected into the engine cylinders via one or more fuel injectors and the engine is producing torque, the controller may make a determination that the engine is operating (e.g., the engine is combusting fuel/air within engine cylinders).

In some examples, the controller may further estimate and/or determine a duration of operation of the engine. For example, the controller may determine how long the engine has been operating for a duration since the most recent engine start request, in one example. In another example, the controller may determine how long the engine has not been operating since a most recent engine shut-off event. During conditions in which the controller determines that the engine is not operating (e.g., the engine is in a non-operating mode and is not combusting fuel/air as described above), the controller may estimate a duration of the non-operating mode based on an engine coolant temperature (e.g., as indicated by signals transmitted to the controller from one or more engine coolant temperature sensors) and/or other estimated and/or measured engine parameters (e.g., operating conditions). During conditions in which the controller determines that the engine is operating (e.g., the engine is in an operating mode in which fuel/air is combusted within engine cylinders as described above), the controller may estimate a duration that the engine has been operating based on the engine coolant temperature and/or other estimated and/or measured engine parameters. In yet other examples, the controller may determine the duration of engine operation or non-operation based on information (e.g., data) stored in a memory (e.g., non-transitory computer memory) of the controller. For example, during conditions in which the engine is transitioned from an operating mode to a non-operating mode, the controller may store information indicating the duration of the operating mode in the memory of the controller. Similarly, during conditions in which the engine is transitioned from the non-operating mode to the operating mode, the controller may store information indicating the duration of the non-operating mode in the memory of the controller.

If the controller determines that the engine is operating at 404, the method continues in response thereto to 406 where the method includes maintaining engine operating conditions. For example, if the engine is operating at 404, at 406 the controller may maintain the speed, torque output, fuel injection rate, and/or other engine operating parameters (e.g., the controller may not adjust the engine operating parameters).

However, if the controller determines at 404 that the engine is not operating (e.g., the engine is in the non-operational mode), the method continues in response thereto to 408 where the method includes determining whether an engine start operation is requested. In one example, an engine start request may be responsive to an ignition key-on event, or an alternate vehicle-on event. As another example, in engines configured with a start-stop button, an engine start request may be responsive to an operator of the engine (e.g., driver of a vehicle including the engine) pressing the start-stop button.

If an engine start request is not indicated at 408, the method continues to 406 in response thereto (e.g., in response to the lack of the engine start request) where the method includes maintaining engine operating conditions. For example, if the engine start request is not indicated at 408, at 406 the controller may maintain the engine in the non-operational mode (e.g., the controller may not inject fuel into engine cylinders and/or initiate spark within the engine cylinders).

However, if an engine start request is indicated at 408, the method continues in response thereto to 410 (e.g., in response to the engine start request and during the engine start request) where the method includes determining a piston position for each cylinder. In one example, the controller may determine the piston position for each cylinder based on signals (e.g., electrical signals) transmitted to the controller by one or more crankshaft position sensors (e.g., Hall effect sensor 120 shown by FIG. 1 and described above). For example, during a most recent engine shut-off event (e.g., an engine shut-off event preceding the determination at 410), the controller may receive electrical signals from the one or more crankshaft position sensors and may estimate and/or measure an amount of rotation of the crankshaft relative to a reference point. In one example, the reference point may correspond to 0° of crankshaft rotation, and the controller may determine the amount of crankshaft rotation relative to the reference point based on the signals transmitted to the controller from the one or more crankshaft position sensors (e.g., 240° relative to the reference point, 300° relative to the reference point, etc.).

Further, the controller may receive signals from the one or more crankshaft position sensors indicating a number of complete rotations of the crankshaft during the most recent duration of engine operation in order to determine the piston position for each cylinder with respect to a firing order of the engine (e.g., the firing order shown by FIG. 3 and described above). For example, the controller may determine that the piston disposed within the first cylinder of the engine (e.g., first cylinder 202 shown by FIG. 2 and described above) is in a position between the top-dead-center (TDC) position and the bottom-dead-center (BDC) position at 410, and may further determine a stroke associated with the position of the piston disposed within the first cylinder. For example, the controller may determine that further rotation of the crankshaft would move the piston in the first cylinder toward the TDC position. Similarly, the controller may determine that the piston disposed within the second cylinder of the engine (e.g., second cylinder 208 shown by FIG. 2 and described above) is in a position between TDC and BDC at 410, and the controller may further determine that rotation of the crankshaft would move the piston disposed within the second cylinder toward the BDC position. The controller may perform a similar determination for each cylinder of the engine (e.g., for each piston disposed within each cylinder of the engine).

In response to determining the piston position for each cylinder at 410 as described above, the method continues from 410 to 412 where the method includes energizing the electric turbocharger coupled to the intake system of the engine to increase the intake air pressure above a threshold pressure. As described above with reference to the electric turbocharger 159 shown by FIG. 1 and the electric turbocharger 285 shown by FIG. 2, the electric turbocharger includes an electric motor (e.g., electric motor 175 of electric turbocharger 159, or electric motor 293 of electric turbocharger 285) configured to drive the compressor of the electric turbocharger (e.g., compressor 174 of electric turbocharger 159, or compressor 294 of electric turbocharger 285) in response to energization of the electric motor. Specifically, the electric motor is configured to spin the compressor of the electric turbocharger during conditions in which the electric motor is energized (e.g., electrical power is directed to the electric motor via one or more electrical power sources of the engine, such as battery 58 shown by FIG. 1 and described above). In one example, the electric motor may spin the compressor in response to a control signal transmitted to the electric motor by the controller. In some examples, the electric motor may be a non-variable speed electric motor that is adjustable between an ON mode (e.g., a mode in which the electric motor spins the compressor of the electric turbocharger) and OFF mode (e.g., a mode in which the electric motor does not spin the compressor of the electric turbocharger), with the adjustment between the ON mode and the OFF mode occurring in response to control signals transmitted to the electric motor by the controller. In another example, the electric motor may be a variable speed electric motor configured to spin the compressor of the electric turbocharger at different speeds in response to different levels of energization of the electric motor. For example, the electric motor may be a direct-current (DC) electric motor, with a speed at which the electric motor spins the compressor being responsive to an electrical voltage supplied to the electric motor. In one example, the electric motor may spin the compressor at a lower, first speed (e.g., 5,000 rotations per minute) in response to a lower, first electrical voltage (e.g., 120 volts) being supplied to the electric motor, and the electric motor may spin the compressor at a higher, second speed (e.g., 10,000 rotations per minute) in response to a higher, second electrical voltage (e.g., 240 volts) being supplied to the electric motor.

At 412, the electric motor is energized (as described above) in order to spin the compressor of the electric turbocharger to increase the intake air pressure above the threshold pressure. For example, the electric motor may be adjusted from the OFF mode to the ON mode in order to increase a pressure of intake air within the intake system above the threshold pressure. In one example, the threshold pressure may be 2.36 atm. In some examples, at 412, a throttle of the engine (e.g., throttle 230 shown by FIG. 2, or throttle 162 shown by FIG. 1) may be in the fully closed position, and the pressure of the intake air may be increased upstream of the throttle (e.g., within boost passage 296 shown by FIG. 2 and described above). In other examples, the throttle of the engine may be in a partially opened position or the fully opened position, and the pressure of the intake air may be increased above the threshold pressure downstream of the throttle (e.g., at the intake manifold).

In response to the energization of the electric turbocharger at 412, optionally continues from 412 to 414 where the method includes adjusting positions of one or more intake valves and/or exhaust valves of the engine. In some examples, adjusting positions of one or more intake valves and/or exhaust valves at 414 occurs while or during the energization of the electric turbocharger at 412. In one example, adjusting the positions of the one or more intake valves and/or exhaust valves may occur prior to the intake air pressure exceeding the threshold pressure. For example, the engine may be configured to include electrically or pneumatically actuated intake valves and/or exhaust valves, such that the positions of the intake valves and/or exhaust valves may be adjusted in response to signals (e.g., electrical signals) transmitted to actuators of the intake valves and/or exhaust valves by the controller. In one example, each of the intake valves (e.g., first intake valve 223, second intake valve 225, and third intake valve 227) may be electrically or pneumatically actuated valves, and each of the exhaust valves (e.g., first exhaust valve 217, second exhaust valve 219, and third exhaust valve 221) may be electrically or pneumatically actuated valves. At 414, the controller may transmit electrical signals to actuators of the intake valves and/or exhaust valves in order to adjust the amount of opening of the intake valves and/or exhaust valves. For example, at 414, one or more of the intake valves may be moved from a partially closed or fully closed position to a fully opened position, and/or one or more of the exhaust valves may be moved from a partially closed or fully closed position to a fully opened position. Similarly, one or more of intake valves may be moved from a partially opened or fully opened position to the fully closed position, and/or one or more of the exhaust valves may be moved from a partially opened or fully opened position to the fully closed position.

In some examples, the controller may determine which intake valves and which exhaust valves to adjust based on the determined piston positions for each cylinder (e.g., the piston positions determined at 410). For example, with respect to the engine 295 shown by FIG. 2 and described above, at 410 the controller may determine that the piston disposed within the second cylinder 208 is in the TDC position, such that rotation of the crankshaft of the engine would move the piston disposed within the second cylinder 208 toward the BDC position. Further, the controller may determine that the pistons disposed within the first cylinder 202 and the third cylinder 214 are in positions between the TDC position and the BDC position, such that rotation of the crankshaft would move the piston disposed within the first cylinder 202 toward the BDC position, and that rotation of the crankshaft would move the piston disposed within the third cylinder 214 toward the TDC position. The controller may determine the relative movement of the pistons in response to a rotation of the crankshaft based on a predetermined firing order (e.g., ignition timing) of the cylinders stored in non-transitory memory of the controller (e.g., the firing order shown by FIG. 3 and described above).

At 410, the controller may determine which pistons are positioned closest to the TDC position and are configured to move toward the BDC position in response to a positive rotation of the crankshaft (e.g., a rotation of the crankshaft in a normal, drive direction of the crankshaft during engine operation). The controller may then, at 414, fully open intake valves coupled to cylinders including the pistons positioned closest to the TDC position and configured to move toward the BDC position. For example, the engine may include only three cylinders, and a single cylinder (e.g., second cylinder 208) of the engine may include a piston positioned closer to TDC than each other piston of each other cylinder, with the piston of the single cylinder being configured to move toward BDC in response to a positive rotation of the crankshaft. The controller at 414 may fully open intake valves coupled to the single cylinder, and may not open intake valves coupled to each other cylinder.

In another example, the engine may include only six cylinders, and two cylinders of the engine may include pistons having a same relative piston position, with the pistons of the two cylinders being positioned closer to TDC than each other piston of each other cylinder, and with the pistons of the two cylinders being configured to move toward BDC in response to a positive rotation of the crankshaft. The controller at 414 may fully open intake valves coupled to the two cylinders, and may not adjust intake valves coupled to each other cylinder. Other examples are possible for engines including different numbers of cylinders (e.g., eight), with the controller opening intake valves of cylinders including pistons positioned closest to TDC and configured to move toward BDC, and with the controller not adjusting intake valves of each other cylinder. The cylinders having intake valves moved to the fully opened position at 414 may be referred to collectively herein as a first cylinder group. For example, the cylinders of the first cylinder group include a first plurality of intake valves and a first plurality of exhaust valves, with each intake valve of the first plurality of intake valves being in an opened position (e.g., the fully opened position) and with each exhaust valve of the first plurality of exhaust valves being in a fully closed position.

Further, the controller may adjust positions of one or more exhaust valves of the engine at 414. Specifically, exhaust valves coupled to each cylinder of the first cylinder group may not be adjusted at 414. However, exhaust valves coupled to each other cylinder (e.g., cylinders not included by the first cylinder group) may be moved to a fully opened position at 414. Cylinders having exhaust valves moved to the fully opened position at 414 may be referred to collectively herein as a second cylinder group, with the second cylinder group being different than the first cylinder group. For example, while flowing compressed air into the cylinders of the first cylinder group to drive the crankshaft (as described below with reference to 416), a gas pressure within cylinders of the second cylinder group may be maintained at atmospheric air pressure due to the cylinders of the second cylinder group including a second plurality of intake valves and a second plurality of exhaust valves, with each intake valve of the second plurality of intake valves being in a fully closed position and each exhaust valve of the second plurality of exhaust valves being in an opened position (e.g., adjusted to the fully opened position at 414).

By adjusting the intake valves of the first cylinder group to the fully opened position and adjusting the exhaust valves of the second cylinder group to the fully opened position at 414, cylinders including pistons that are not moving toward the BDC position (e.g., cylinders within the second cylinder group) may be maintained at atmospheric pressure (e.g., via ventilation of trapped gases to atmosphere through an exhaust passage, such as exhaust passage 283 shown by FIG. 2 and described above). Further, cylinders including pistons that are moving toward the BDC position (e.g., cylinders within the first cylinder group) have their intake valves opened in order to fluidically couple the cylinders to one or more intake passages of the engine (e.g., intake passage 228 shown by FIG. 2 and described above).

In examples of engines that do not include electrically or pneumatically actuated intake valves and exhaust valves (e.g., engines including mechanically actuated valves, such as valves opened and closed via rotation of cams of one or more camshafts), the method may not include 414. Instead, the method may continue from 412 to 416.

At 416, the method includes initiating crankshaft rotation by flowing pressurized intake air to engine cylinders to drive pistons disposed within the cylinders for a duration via only the pressurized intake air. In some examples, flowing pressurized intake air to engine cylinders occurs while or during the energization of the electric turbocharger at 412, and/or while or during adjustment of the one or more intake valves and/or exhaust valves at 414. In one example, adjusting the positions of the one or more intake valves and/or exhaust valves may occur prior to flowing pressurized intake air to the engine cylinders. For example, the pressure of intake air at an intake junction of each cylinder (e.g., intake junctions 233, 235, and 237 shown by FIG. 2 and described above) may be increased above the threshold pressure at 412. However, at 412, one or more intake valves of the cylinders (e.g., first intake valve 223, second intake valve 225, and/or third intake valve 227) may be in a fully closed position (e.g., intake valves coupled to cylinders of the second cylinder group). Cylinders including intake valves that are fully closed during the energization of the electric motor at 412 may not receive the pressurized intake air flowing from the compressor. For example, with respect to the method at 412 applied to the intake junction 233, first intake valve 223, and intake port 232 fluidly coupling the first cylinder 202 to the intake passage 228 as shown by FIG. 2 and described above, at 412 the first intake valve 223 may be in the fully closed position. As a result, at 412, intake air within the intake junction 233 may be pressurized above the threshold pressure, but the pressurized intake air does not flow into the first cylinder 202 (e.g., does not flow through the intake port 232 and around the first intake valve 223).

Flowing pressurized intake air to engine cylinders at 416 may increase a pressure of intake air within the cylinders in order to drive the pistons disposed within the cylinders. Specifically, at 416, fuel/air are not combusted within engine cylinders, and the pistons disposed within the cylinders are driven by only the pressurized intake air flowing into the cylinders.

With regard to engines that include electrically or pneumatically actuated intake valves and exhaust valves, pressurized air may flow into the cylinders of the first cylinder group (e.g., cylinders having intake valves in the fully opened position) in order to drive pistons disposed within the cylinders of the first cylinder group and to rotate the crankshaft of the engine (e.g., drive the pistons disposed within the cylinders of the first cylinder group toward the bottom-dead-center position). By opening the exhaust valves of the cylinders of the second cylinder group at 414, an amount of force to drive the pistons of the first cylinder group may be reduced. For example, as described above, opening the exhaust valves of the cylinders of the second cylinder group maintains the cylinders of the second cylinder group at atmospheric pressure (e.g., as pistons disposed within cylinders of the second cylinder group are driven toward the top-dead-center position). As pressurized air flows into the cylinders of the first cylinder group, the pistons disposed within the cylinders of the first cylinder group may be driven by the pressurized air to drive the crankshaft of the engine without additional resistance resulting from compression of air within the cylinders of the second cylinder group. In this way, the pistons may be driven by a reduced amount of pressurized air and/or a reduced pressure of the pressurized air, resulting in a decreased response time of the engine (e.g., a decreased amount of time t0 initiate rotation of the crankshaft) and a reduced amount of electrical energy expended to energize the electric motor of the electric turbocharger (e.g., in order to increase the intake air pressure above the threshold pressure). In some examples, with regard to engines including electrically or pneumatically actuated intake valves and exhaust valves adjusted as described above at 414, the threshold pressure described at 412 may be reduced. For example, the threshold pressure may be less than 2.36 atm for such engines (e.g., 2 atm).

With regard to engines that include mechanically actuated intake valves and exhaust valves (e.g., valves actuated via contact with rotating cams of one or more camshafts), the positions of the intake valves and exhaust valves may not be adjusted at 414. As a result, pressurized intake air flowing to engine cylinders at 416 flows into cylinders having intake valves that are in a partially opened or fully opened position. In one example, the intake valves may be in the partially opened or fully opened position as a result of the position (e.g., amount of rotation) of the crankshaft at the most recent engine shutdown event (e.g., an event in which the engine is transitioned from operation to non-operation responsive to engine key-off, in one example). In some examples, in response to the engine shutdown event, the controller may adjust ignition timing (e.g., spark timing and/or fuel injection timing) during engine shutdown in order to position the crankshaft at a specific amount of rotation (e.g., 120 degrees relative to the reference point described above) following engine shutdown. For example, the crankshaft may be rotated to a position such that one or more of the pistons of the engine are at TDC with intake valves of the corresponding cylinders including the pistons being in the fully opened position, prior to running the method 400 (e.g., prior to the engine start request and responsive to an engine shutdown event immediately prior to the engine start request with no other engine shutdown event or engine start request between). In this configuration, as pressurized intake air flows to the cylinders at 416, the pressurized air may flow into the cylinders having intake valves in the fully opened position in order to more easily drive pistons disposed within the cylinders from the TDC position toward the BDC position and to rotate the crankshaft.

Pressurized intake air may flow to the cylinders at 416 for a duration in order to rotate the crankshaft through a number of complete rotations greater than a threshold number and/or to rotate the crankshaft at a speed greater than a threshold speed. For example, with regard to engines including electrically actuated or pneumatically actuated intake valves and exhaust valves, pressurized air may be delivered to the cylinders as the amount of opening of the intake valves and exhaust valves is adjusted by the controller in order to enable the pressure of the intake air to drive the pistons and to produce torque via rotation of the crankshaft. In one example, the threshold number of complete crankshaft rotations may be two, corresponding to 720 degrees of crank rotation, such that the duration spans at least 720 degrees of crankshaft rotation. In other examples, the threshold number of complete crankshaft rotations may be a different number (e.g., four). In another example, the threshold speed of the crankshaft may be 75 rotations per minute. The intake valves and exhaust valves may be opened and closed by the controller throughout the duration in order to enable the pistons to be driven by the pressurized air with an increased amount of force applied to the crankshaft. For example, during conditions in which a piston is moving from the BDC position toward the TDC position, the exhaust valve of the cylinder including the piston may be opened by the controller in order to reduce an amount of gases compressed by the piston, thereby enabling the pressurized air delivered to cylinders having open intake valves to more efficiently drive the pistons and crankshaft. One example of intake valve and exhaust valve adjustment through the duration described with reference to 416 is illustrated by FIG. 6 and described below.

With regard to engines that include mechanically actuated intake valves and exhaust valves, the pressurized air may flow into the engine cylinders according to a pre-determined intake valve opening order throughout the duration. For example, because the intake valves and exhaust valves are driven via rotation of cams coupled to one or more rotatable camshafts, a relative intake valve timing (e.g., intake valve opening and closing timing) and exhaust valve timing (e.g., exhaust valve opening and closing timing) is pre-determined according to a shape, size, relative position, etc. of the cams. As such, the intake valve timing and exhaust valve timing may not be adjustable via the controller. Therefore, throughout the duration described with reference to 416 (e.g., the flowing of pressurized intake air to the cylinders to rotate the crankshaft through the threshold number of rotations and/or to rotate the crankshaft above the threshold speed), intake valves and exhaust valves of engines that do not include electrically or pneumatically actuated valves may open and close according to the pre-determined valve timing (as illustrated by FIG. 5 and described below). The pre-determined valve timing may be stored in non-transitory memory of the controller.

The method continues from 416 to 418 where the method includes initiating combustion of fuel and air within engine cylinders. In one example, the controller may transmit signals (e.g., electrical signals) to one or more spark plugs disposed within the cylinders of the engine in order to initiate combustion of fuel and air within the engine cylinders. Fuel may be injected into the engine cylinders via one or more fuel injectors (e.g., fuel injector 166 shown by FIG. 1, fuel injectors 271, 273, and/or 275 shown by FIG. 2, etc.). The controller may initiate combustion in engine cylinders based on the positions of the pistons disposed within the cylinders at 418. In one example, the controller may estimate and/or measure the positions of the pistons based on signals transmitted to the controller by the one or more crankshaft position sensors (e.g., Hall effect sensor 120 described above), and the controller may initiate spark and/or fuel injection to specific cylinders of the engine based on the estimated and/or measured piston positions. For example, the controller may determine a stroke of each piston based on the measured and/or estimated piston positions and the amount of opening of the intake valves and exhaust valves of each cylinder, and the controller may inject fuel and/or initiate spark in engine cylinders undergoing a compression stroke (e.g., as described above with reference to FIG. 3). The controller at 418 transitions the engine from the mode (which may be referred to herein as a startup mode or transitional mode) in which the pistons are driven only by the pressurized intake air (and fuel and air are not combusted within the engine cylinders) to an operational mode in which fuel and air are combusted within engine cylinders.

In an example of the method 400 shown by FIG. 4 and described herein, the engine may be in a non-operational state in which fuel and air are not combusted within the engine cylinders and the pistons are not driven by pressurized air. An operator of the engine (e.g., a driver of a vehicle including the engine) may initiate a key-on event in order to indicate to the controller that an engine start is requested. During the engine start request, the controller may determine the piston position for each cylinder as described at 410, and may energize the electric turbocharger in order to increase the intake air pressure above the threshold pressure, as described at 412. The engine may include intake valves and exhaust valves that are electrically or pneumatically actuated, and the controller may adjust the positions of the intake valves and exhaust valves at 414 in order to reduce an amount of force (e.g., pressure from pressurized intake air) to drive the pistons of the engine with the pressurized intake air during the engine start request. The pressurized intake air flows to the cylinders at 416 during the engine start request and pressurizes one or more of the cylinders in order to drive the pistons disposed therein and to rotate the crankshaft without combustion of fuel and air. Once the crankshaft has rotated through the threshold number of rotations and/or has exceeded the threshold rotation speed, the controller initiates fuel and air combustion within the engine cylinders in order to produce an increased amount of torque via the crankshaft (e.g., to run the engine in an operating mode, wherein fuel and air are combusted within the engine cylinders according to a pre-determined ignition timing of the engine, with the pre-determined ignition timing stored in non-transitory memory of the controller).

In some examples, the method optionally continues from 418 to 420 where the method includes reducing engine speed via one or more speed reduction routines. For example, due to the delivery of compressed intake air to the engine cylinders to drive the pistons and the crankshaft for the duration prior to combustion of fuel and air within the engine cylinders, the engine may operate at a relatively high level of boost upon initiation of fuel and air combustion within the engine cylinders at 418. In order to reduce an amount of torque output by the engine during the initial combustion of fuel and air, the controller may adjust various engine parameters via one or more speed reduction routines stored in non-transitory memory of the controller in order to decrease a magnitude of an engine speed increase provided by the relatively high levels of boost. In one example, the controller may transmit a signal (e.g., electrical signal) to a bypass valve (e.g., bypass valve 226 shown by FIG. 2 and described above) in order to increase an amount of opening of the bypass valve (e.g., electric turbocharger bypass valve) and to reduce an amount of compressed air flowing to the engine. In another example, for engines including intake valves and exhaust valves that are electrically or pneumatically actuated, the controller may adjust an opening time of one or more of the intake valves and/or exhaust valves in order to temporarily reduce a torque output of the engine. in yet another example, the controller may adjust an ignition timing of one or more cylinders in order to reduce the amount of work (e.g., engine torque) resulting from the combusted fuel and air within the one or more cylinders. Other examples are possible.

In some examples, determining the piston position for each cylinder occurs while or during energizing the electric turbocharger (e.g., energizing the electric motor of the electric turbocharger) to increase the intake air pressure above the threshold pressure, and energizing the electric turbocharger occurs while determining the piston position is not present and/or while or during adjusting the positions of the one or more intake valves and/or exhaust valves. Further, instructions stored in memory of the controller may include determining whether an engine start is requested, and in response to the engine start request, increasing the intake air pressure above the threshold pressure by instructions for sending a signal (e.g., electrical signal) to an actuator of the electric motor of the electric turbocharger, adjusting the positions of the one or more intake valves and/or exhaust valves by instructions for sending a signal to actuators of the one or more intake valves and/or exhaust valves, and/or flowing pressurized intake air to engine cylinders by instructions for sending a signal to actuators of one or more valves (e.g., the throttle, or bypass valve) to adjust the positions of the valves. Further, instructions stored in memory of the controller may include determining whether an engine start is not requested, and in response, maintaining engine operating conditions as described above. In some examples the method may include determining whether to perform one or more of each of increasing the intake air pressure, adjusting the positions of the one or more valves, and/or flowing pressurized intake air to engine cylinders based on a determination of whether the engine is operating and a determination of whether an engine start is requested (e.g., present).

Turning now to FIG. 5, a graph 500 is shown illustrating engine parameters such as piston position, intake valve lifts (e.g., intake valve opening amounts), exhaust valve lifts (e.g., exhaust valve opening amounts), etc. In one example, the engine parameters shown by FIG. 5 may be parameters of engine 295 shown by FIG. 2 and described above, or engine 10 shown by FIG. 1 and described above. The engine parameters shown by FIG. 5 correspond to an engine that does not include electrically or pneumatically actuated intake valves and exhaust valves. For example, the intake valves and exhaust valves of the engine may be mechanically actuated (e.g., cam driven), as described above.

FIG. 5 shows electric turbocharger energization at plot 506 (e.g., energization of electric motor 175 or electric motor 293) and turbocharger speed at plot 508 (e.g., speed of turbocharger 159 or turbocharger 285). FIG. 5 additionally shows spark timing (e.g., ignition timing) for each cylinder, including spark timing of a first cylinder at plot 510 (e.g., spark timing of first spark plug 277 of first cylinder 202), spark timing of a second cylinder at plot 512 (e.g., spark timing of second spark plug 279 of second cylinder 208), and spark timing of a third cylinder at plot 514 (e.g., spark timing of third spark plug 281 of third cylinder 214). Fuel injection rates for the cylinders are included, with fuel injection rate at the first cylinder shown at plot 516 (e.g., fuel injection rate of first fuel injector 277), fuel injection rate at the second cylinder shown at plot 518 (e.g., fuel injection rate of second fuel injector 279), and fuel injection rate at the third cylinder shown at plot 520 (e.g., fuel injection rate for third fuel injector 281). Cylinder pressure within the first cylinder is shown at plot 522 (e.g., cylinder gas pressure), cylinder pressure within the second cylinder is shown at plot 524, cylinder pressure within the third cylinder is shown at plot 526. Atmospheric pressure is indicated at 546, and a first threshold pressure (e.g., the threshold pressure described above at 412) is indicated at 548. Piston position within the first cylinder is shown at plot 528, piston position within the second cylinder is shown at plot 530, and piston position within the third cylinder is shown at plot 532. Intake valve lift of an intake valve coupled to the first cylinder is shown at plot 534 (e.g., first intake valve 223), intake valve lift of an intake valve coupled to the second cylinder is shown at plot 536 (e.g., second intake valve 225), and intake valve lift of an intake valve coupled to the third cylinder is shown at plot 538 (e.g., third intake valve 227). Exhaust valve lift of an exhaust valve coupled to the first cylinder is shown at plot 540 (e.g., first exhaust valve 217), exhaust valve lift of an exhaust valve coupled to the second cylinder is shown at plot 542 (e.g., second exhaust valve 219), and exhaust valve lift of an exhaust valve coupled to the third cylinder is shown at plot 544 (e.g., third exhaust valve 221).

At time t0, the engine is not operating (e.g., fuel and air are not combusted within engine cylinders, and the engine is not producing torque). At time t1, in response to an engine start request (e.g., as described above with reference to 408), the electric turbocharger is energized as shown by plot 506 and as described above with reference to 412. Between time t1 and t2, the speed of the electric turbocharger is increased as shown by plot 508.

The increased speed of the turbocharger corresponds to a spinning of the compressor of the electric turbocharger (e.g., via the electric motor of the electric turbocharger) in order to increase the pressure of the intake air within the intake system. In one example, at time t2, throttle of the engine may be moved to the fully opened position (e.g., as described above) in order to flow the pressurized intake air to the engine cylinders. Because the intake valve of the first cylinder is in an opened position at time t2 (e.g., as indicated by plot 534), the pressurized intake air flows into the first cylinder (e.g., as described above with reference to 416) and begins to drive the piston disposed within the first cylinder (e.g., as shown by plot 528). As the piston of the first cylinder is driven by the pressurized intake air, the crankshaft of the engine is rotated by the movement of the piston, thereby moving each piston relative to each other piston. In some examples, an opening time of each intake valve may overlap with an opening time of one or more other intake valves. For example, the intake valve lift of the intake valve of the first cylinder indicated by plot 534 may overlap slightly with the intake valve lift of the intake valve of the second cylinder indicated by plot 536 and/or intake valve lift of the intake valve of the third cylinder indicated by plot 538.

Between times t2 and t4, as the piston disposed within the first cylinder is driven towards the BDC position as indicated by plot 528 due to the flow of pressurized intake air into the first cylinder via the open intake valve of the first cylinder (indicated by plot 534), the piston disposed within the third cylinder is driven from the BDC position toward the TDC position by the rotation of the crankshaft (e.g., via the driving of the piston disposed within the first cylinder due to the pressurized air). The intake valve of the third cylinder is then moved from the fully closed position towards the fully opened position as indicated by plot 538, and the pressurized intake air flows into the third cylinder in order to drive the piston disposed within the third cylinder from the TDC position toward the BDC position to further rotate the crankshaft. Similarly, as the piston disposed within the third cylinder is driven towards the BDC position by the pressurized intake air, the piston disposed within the second cylinder is moved from the BDC position toward the TDC position by the rotation of the crankshaft (e.g., via the driving of the piston disposed within the third cylinder due to the pressurized air). The intake valve of the second cylinder is moved from the fully closed position toward the fully opened position as indicated by plot 536, and the pressurized intake air flows into the second cylinder in order to drive the piston disposed within the second cylinder from the TDC position toward the BDC position to further rotate the crankshaft.

At time t3, during the opening of the intake valve of the second cylinder, fuel is injected into the second cylinder as indicated by plot 518. The crankshaft continues to rotate, and at time t5 spark is initiated in the second cylinder as indicated by plot 512. After time t5, the crankshaft is driven by combusted fuel and air according to a pre-determined ignition timing of the engine stored in non-transitory memory of the controller (e.g., such as the ignition timing described above with reference to FIG. 3).

Turning now to FIG. 6, a graph 600 is shown illustrating engine parameters such as piston position, intake valve lifts (e.g., intake valve opening amounts), exhaust valve lifts (e.g., exhaust valve opening amounts), etc. In one example, the engine parameters shown by FIG. 6 may be parameters of engine 295 shown by FIG. 2 and described above, or engine 10 shown by FIG. 1 and described above. The engine parameters shown by FIG. 6 correspond to an engine that does includes electrically or pneumatically actuated intake valves and exhaust valves. For example, the intake valves and exhaust valves may be opened and/or closed in response to control signals transmitted to actuators of the valves by the controller, as described above.

FIG. 6 shows electric turbocharger energization at plot 606 (e.g., energization of electric motor 175 or electric motor 293) and turbocharger speed at plot 608 (e.g., speed of turbocharger 159 or turbocharger 285). FIG. 6 additionally shows spark timing (e.g., ignition timing) for each cylinder, including spark timing of a first cylinder at plot 610 (e.g., spark timing of first spark plug 277 of first cylinder 202), spark timing of a second cylinder at plot 612 (e.g., spark timing of second spark plug 279 of second cylinder 208), and spark timing of a third cylinder at plot 614 (e.g., spark timing of third spark plug 281 of third cylinder 214). Fuel injection rates for the cylinders are included, with fuel injection rate at the first cylinder shown at plot 616 (e.g., fuel injection rate of first fuel injector 277), fuel injection rate at the second cylinder shown at plot 618 (e.g., fuel injection rate of second fuel injector 279), and fuel injection rate at the third cylinder shown at plot 620 (e.g., fuel injection rate for third fuel injector 281). Cylinder pressure within the first cylinder is shown at plot 622 (e.g., cylinder gas pressure), cylinder pressure within the second cylinder is shown at plot 624, cylinder pressure within the third cylinder is shown at plot 626. Atmospheric pressure is indicated at 646, and a first threshold pressure (e.g., the threshold pressure described above at 412) is indicated at 648. Piston position within the first cylinder is shown at plot 628, piston position within the second cylinder is shown at plot 630, and piston position within the third cylinder is shown at plot 632. Intake valve lift of an intake valve coupled to the first cylinder is shown at plot 634 (e.g., first intake valve 223), intake valve lift of an intake valve coupled to the second cylinder is shown at plot 636 (e.g., second intake valve 225), and intake valve lift of an intake valve coupled to the third cylinder is shown at plot 638 (e.g., third intake valve 227). Exhaust valve lift of an exhaust valve coupled to the first cylinder is shown at plot 640 (e.g., first exhaust valve 217), exhaust valve lift of an exhaust valve coupled to the second cylinder is shown at plot 642 (e.g., second exhaust valve 219), and exhaust valve lift of an exhaust valve coupled to the third cylinder is shown at plot 644 (e.g., third exhaust valve 221).

At time t0, the engine is not operating (e.g., fuel and air are not combusted within engine cylinders, and the engine is not producing torque). At time t1, in response to an engine start request (e.g., as described above with reference to 408), the electric turbocharger is energized as shown by plot 606 and as described above with reference to 412. Between time t1 and t2, the speed of the electric turbocharger is increased as shown by plot 608. Additionally, because the engine includes electrically or pneumatically actuated intake valves and exhaust valves, at time t1 the controller transmits signals (e.g., electrical signals) to actuators of the exhaust valves of the second cylinder and third cylinder (indicated by plots 642 and 644, respectively) in order to move the exhaust valves of the second cylinder and third cylinder to the fully opened position. With the exhaust valves in the fully opened position, pressures within the second cylinder and third cylinder may be reduced the atmospheric pressure (as described above with reference to 414 of FIG. 4) such that the piston disposed within the first cylinder may be driven with a reduced amount of force.

The increased speed of the turbocharger corresponds to a spinning of the compressor of the electric turbocharger (e.g., via the electric motor of the electric turbocharger) in order to increase the pressure of the intake air within the intake system. In one example, at time t2, the intake valve of the first cylinder is moved to the fully opened position (e.g., as indicated by plot 634) in order to flow the pressurized intake air into the first cylinder. The pressurized intake air flows into the first cylinder (e.g., as described above with reference to 416) and begins to drive the piston disposed within the first cylinder (e.g., as shown by plot 628). As the piston of the first cylinder is driven by the pressurized intake air, the crankshaft of the engine is rotated by the movement of the piston, thereby moving each piston relative to each other piston. In some examples, an opening time of each intake valve may overlap with an opening time of one or more other intake valves. For example, the intake valve lift of the intake valve of the first cylinder indicated by plot 634 may overlap slightly with the intake valve lift of the intake valve of the second cylinder indicated by plot 636 and/or intake valve lift of the intake valve of the third cylinder indicated by plot 638.

Between times t2 and t4, as each piston is driven from the TDC position toward the BDC position, the intake valve associated with the cylinder of each position is moved into the fully opened position in order to enable pressurized intake air to flow into the cylinders. For example, at time t2, the intake valve of the first cylinder is moved to the fully opened position as indicated by plot 634 in order to enable intake air to flow into the first cylinder to drive the first piston (and rotate the crankshaft of the engine). The rotation of the crankshaft results in the second piston moving toward the TDC position as indicated by plot 630, and as the second piston moves toward the BDC position from the TDC position, the intake valve of the second cylinder is fully opened (as indicated by plot 636) to enable pressurized intake air to flow into the second cylinder to drive the second piston. Similarly, following the movement of the second piston from TDC, the rotation of the crankshaft moves the third piston to TDC, and the intake valve of the third cylinder is opened to enable pressurized intake air to drive the third piston from TDC to BDC.

As each piston moves from BDC toward TDC between times t2 and t3, the exhaust valves coupled to each corresponding cylinder are opened in order to enable the crankshaft to be more easily rotated. For example, as the first piston is driven from BDC to TDC, the exhaust valve of the first cylinder including the first piston is fully opened in order to reduce an amount of pressure (e.g., gas pressure) within the first cylinder so that the first piston may more easily be moved toward TDC (e.g., without compressing gases within the first cylinder). The exhaust valves of each other cylinder are operated in a similar way.

In this configuration, the actuation of the intake valves and exhaust valves by the controller enables the rotation of the crankshaft to quickly accelerate due to the driving of the pistons via the pressurized intake air.

At time t3, while the intake valve of the second cylinder is in the fully opened position, fuel is injected into the second cylinder as indicated by plot 618. The crankshaft continues to rotate, and at time t5 spark is initiated in the second cylinder as indicated by plot 612. After time t5, the crankshaft is driven by combusted fuel and air according to a pre-determined ignition timing of the engine (e.g., such as the ignition timing described above with reference to FIG. 3).

In the configurations described above, pressurized air from the compressor of the electric turbocharger drives the pistons of the engine in response to the engine start request in order to rotate the crankshaft prior to combustion of fuel and air within the engine cylinders. By driving the pistons via only the pressurized air, the engine may be started without additional components such as a dedicated starter motor. Additionally, the electric turbocharger may include a turbine driven by exhaust gases during normal engine operation (e.g., during conditions in which the engine is driven by combustion of fuel and air). By reducing the amount of components to start the engine (e.g., by starting the engine via the electric turbocharger and without a separate starter motor), a cost and/or maintenance time of the engine may be reduced.

In this way, by starting the engine via the electric turbocharger according to the methods described above, the engine may be started without a starter motor (e.g., a separate motor configured to crank, or rotate, the crankshaft during engine startup via a mechanical coupling, such as a belt, positioned between the starter motor and crankshaft). By starting the engine via the electric turbocharger, the engine may be configured without a starter motor, thereby decreasing a weight and cost of the engine. Further, spinning the compressor of the electric turbocharger during engine startup may enable a faster response time for delivery of boost (e.g., compressed air) to the engine following engine startup. As a result, engine performance and efficiency may be increased.

The technical effect of flowing compressed intake air to engine cylinders during an engine start request is to drive pistons of the engine to rotate a crankshaft of the engine prior to combustion of fuel and air within the engine cylinders.

In one embodiment, a method for an engine comprises: during an engine start request, driving a crankshaft of the engine without combustion only by flowing compressed air from an electrically driven air compressor to cylinders of the engine and without actuating a starter motor coupled to the crankshaft. In a first example of the method, the electrically driven air compressor is part of an electric turbocharger and the flowing of compressed air from the electric turbocharger includes energizing an electric motor of the electric turbocharger in response to the engine start request to spin the air compressor of the electric turbocharger. A second example of the method optionally includes the first example, and further includes wherein the electrically driven air compressor is part of an electric turbocharger and the flowing of compressed air from the electric turbocharger includes increasing a pressure of the compressed air above a threshold pressure by spinning the air compressor of the electric turbocharger. A third example of the method optionally includes one or both of the first and second examples, and further includes wherein the threshold pressure is greater than 2 atm. A fourth example of the method optionally includes one or more or each of the first through third examples, and further includes wherein the pressure of the compressed air is first increased above the threshold pressure within an intake passage upstream of a throttle of the engine; then, the throttle is opened to flow the compressed air to the cylinders. A fifth example of the method optionally includes one or more or each of the first through fourth examples, and further includes wherein the pressure of the compressed air is first increased above the threshold pressure at an intake manifold of the engine; then, adjusting an intake valve of the cylinders from a fully closed position to an opened position to flow the compressed air to the cylinders. A sixth example of the method optionally includes one or more or each of the first through fifth examples, and further includes determining a position of each piston disposed within each cylinder of the cylinders, and adjusting the intake valve based on the determined position of each piston. A seventh example of the method optionally includes one or more or each of the first through sixth examples, and further includes: after a duration of driving the crankshaft of the engine without combustion only by flowing compressed air from the electric turbocharger to cylinders of the engine and without actuating the starter motor, injecting fuel into the cylinders, and combusting the fuel and compressed air within the cylinders. An eighth example of the method optionally includes one or more or each of the first through seventh examples, and further includes wherein the duration is based on a rotation speed of the crankshaft exceeding a threshold rotation speed. A ninth example of the method optionally includes one or more or each of the first through eighth examples, and further includes wherein the duration is based on a number of complete rotations of the crankshaft exceeding a threshold number of complete rotations following the engine start request. A tenth example of the method optionally includes one or more or each of the first through ninth examples, and further includes wherein fuel and air are not combusted within the cylinders throughout the entire duration of driving the crankshaft only by flowing compressed air from the electric turbocharger to the cylinders. An eleventh example of the method optionally includes one or more or each of the first through tenth examples, and further includes reducing engine speed following the duration via a speed reduction routine stored in a non-transitory memory of an electronic controller of the engine. A twelfth example of the method optionally includes one or more or each of the first through eleventh examples, and further includes wherein the speed reduction routine includes one of increasing an amount of opening of an electric turbocharger bypass valve coupled in parallel with the air compressor, adjusting an opening time of an intake valve and/or exhaust valve of the cylinders, or adjusting an ignition timing of the cylinders.

In another embodiment, a method for an engine comprises: in response to an engine start request, flowing compressed intake air to engine cylinders from a compressor of an electric turbocharger and driving pistons disposed within the engine cylinders via only the compressed intake air for a duration, with an amount of opening of intake valves and exhaust valves coupled to the engine cylinders being adjusted throughout the duration via cams of camshafts; and transitioning from driving the pistons via only the compressed intake air to driving the pistons via combustion of fuel and air by initiating combustion within the engine cylinders following the duration. In a first example of the method, the method further comprises, prior to the engine start request and responsive to an engine shutdown event immediately prior to the engine start request with no other engine shutdown event or engine start request between, adjusting ignition timing of the engine to position a first piston at a top dead center position on engine shutdown, with a first intake valve coupled to a first cylinder including the first piston being in a fully opened position. A second example of the method optionally includes the first example, and further includes wherein the duration spans at least 720 degrees of crankshaft rotation.

In another embodiment, a method for an engine comprises: responsive to an engine start request: flowing compressed air into cylinders of a first cylinder group to drive a crankshaft of the engine via only the compressed air, the cylinders of the first cylinder group including a first plurality of intake valves and a first plurality of exhaust valves, with each intake valve of the first plurality of intake valves being in an opened position and with each exhaust valve of the first plurality of exhaust valves being in a fully closed position; and while flowing compressed air into the cylinders of the first cylinder group to drive the crankshaft, maintaining a gas pressure within cylinders of a second cylinder group at atmospheric air pressure, the cylinders of the second cylinder group including a second plurality of intake valves and a second plurality of exhaust valves, with each intake valve of the second plurality of intake valves being in a fully closed position and each exhaust valve of the second plurality of exhaust valves being in an opened position. In a first example of the method, the method further comprises: prior to flowing compressed air into the cylinders of the first cylinder group to drive the crankshaft and during the engine start request, increasing an amount of opening of an intake valve of the first plurality of intake valves via an electronic controller of the engine. A second example of the method optionally includes the first example, and further includes: prior to flowing compressed air into the cylinders of the first cylinder group to drive the crankshaft and during the engine start request, increasing an amount of opening of an exhaust valve of the second plurality of exhaust valves via an electronic controller of the engine. A third example of the method optionally includes one or both of the first and second examples, and further includes wherein flowing compressed air into cylinders of the first cylinder group responsive to the engine start request drives pistons disposed within the cylinders of the first cylinder group toward a bottom-dead-center position and drives pistons disposed within the cylinders of the second cylinder group toward a top-dead-center position, with the gas pressure within the cylinders of the second cylinder group being maintained at atmospheric air pressure as the pistons disposed within the cylinders of the second cylinder group are driven toward the top-dead-center position.

In another representation, a method for an engine of a hybrid electric vehicle (HEV) comprises: during an engine start request, driving a crankshaft of the engine without combustion only by flowing compressed air from an electric turbocharger to cylinders of the engine and without actuating a starter motor or a primary electric motor of the HEV.

With regard to hybrid electric vehicles (HEVs), in some examples, starting the engine via the electric turbocharger may be a secondary or backup method of starting the engine, with a primary method being inducing vehicle motion with the engine unfueled but engaged (e.g., with the crankshaft rotating) while a primary electric motor (e.g., an electric motor configured to propel the vehicle) powers the vehicle. In another example, the primary electric motor may power the engine without a transmission of the engine being engaged with the engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during an engine start request, driving a crankshaft of the engine in a normal, positive rotation direction without combustion only by flowing compressed air from an electrically driven air compressor to cylinders of the engine and without actuating a starter motor coupled to the crankshaft.

2. The method of claim 1, wherein the electrically driven air compressor is part of an electric turbocharger and the flowing of compressed air from the electric turbocharger includes energizing an electric motor of the electric turbocharger in response to the engine start request to spin the air compressor of the electric turbocharger.

3. The method of claim 1, wherein the electrically driven air compressor is part of an electric turbocharger and the flowing of compressed air from the electric turbocharger includes increasing a pressure of the compressed air above a threshold pressure by spinning the air compressor of the electric turbocharger.

4. The method of claim 3, wherein the threshold pressure is greater than 2 atm.

5. The method of claim 3, wherein the pressure of the compressed air is first increased above the threshold pressure within an intake passage upstream of a throttle of the engine; then, the throttle is opened to flow the compressed air to the cylinders.

6. The method of claim 3, wherein the pressure of the compressed air is first increased above the threshold pressure at an intake manifold of the engine; then, adjusting an intake valve of the cylinders from a fully closed position to an opened position to flow the compressed air to the cylinders.

7. The method of claim 6, further comprising determining a position of each piston disposed within each cylinder of the cylinders, and adjusting the intake valve based on the determined position of each piston.

8. The method of claim 1, further comprising: after a duration of driving the crankshaft of the engine in the normal, positive rotation direction without combustion only by flowing compressed air from the electrically driven air compressor to cylinders of the engine and without actuating the starter motor, injecting fuel into the cylinders, and combusting the fuel and compressed air within the cylinders.

9. The method of claim 8, wherein the duration is based on a rotation speed of the crankshaft exceeding a threshold rotation speed.

10. The method of claim 8, wherein the duration is based on a number of complete rotations of the crankshaft exceeding a threshold number of complete rotations following the engine start request.

11. The method of claim 8, wherein fuel and air are not combusted within the cylinders throughout the entire duration of driving the crankshaft in the normal, positive rotation direction only by flowing compressed air from the electrically driven air compressor to the cylinders.

12. The method of claim 8, further comprising reducing engine speed following the duration via a speed reduction routine stored in a non-transitory memory of an electronic controller of the engine.

13. The method of claim 12, wherein the speed reduction routine includes one of increasing an amount of opening of an electric turbocharger bypass valve coupled in parallel with the air compressor, adjusting an opening time of an intake valve and/or exhaust valve of the cylinders, or adjusting an ignition timing of the cylinders.

14. A method for an engine, comprising:

in response to an engine start request, flowing compressed intake air to engine cylinders from a compressor of an electric turbocharger and driving pistons disposed within the engine cylinders in a direction corresponding to a normal, positive rotation of a crankshaft coupled to the pistons via only the compressed intake air for a duration, with an amount of opening of intake valves and exhaust valves coupled to the engine cylinders being adjusted throughout the duration via cams of camshafts; and transitioning from driving the pistons via only the compressed intake air to driving the pistons via combustion of fuel and air by initiating combustion within the engine cylinders following the duration.

15. The method of claim 14, further comprising, prior to the engine start request and responsive to an engine shutdown event immediately prior to the engine start request with no other engine shutdown event or engine start request between, adjusting ignition timing of the engine to position a first piston at a top dead center position on engine shutdown, with a first intake valve coupled to a first cylinder including the first piston being in a fully opened position.

16. The method of claim 14, wherein the duration spans at least 720 degrees of rotation of the crankshaft.

17. A method for an engine, comprising:

responsive to an engine start request:

flowing compressed air into cylinders of a first cylinder group to drive a crankshaft of the engine in a normal, positive rotation direction via only the compressed air, the cylinders of the first cylinder group including a first plurality of intake valves and a first plurality of exhaust valves, with each intake valve of the first plurality of intake valves being in an opened position and with each exhaust valve of the first plurality of exhaust valves being in a fully closed position; and while flowing compressed air into the cylinders of the first cylinder group to drive the crankshaft in the normal, positive rotation direction, maintaining a gas pressure within cylinders of a second cylinder group at atmospheric air pressure, the cylinders of the second cylinder group including a second plurality of intake valves and a second plurality of exhaust valves, with each intake valve of the second plurality of intake valves being in a fully closed position and each exhaust valve of the second plurality of exhaust valves being in an opened position.

18. The method of claim 17, further comprising: prior to flowing compressed air into the cylinders of the first cylinder group to drive the crankshaft in the normal, positive rotation direction and during the engine start request, increasing an amount of opening of an intake valve of the first plurality of intake valves via an electronic controller of the engine.

19. The method of claim 17, further comprising: prior to flowing compressed air into the cylinders of the first cylinder group to drive the crankshaft in the normal, positive rotation direction and during the engine start request, increasing an amount of opening of an exhaust valve of the second plurality of exhaust valves via an electronic controller of the engine.

20. The method of claim 17, wherein flowing compressed air into cylinders of the first cylinder group responsive to the engine start request drives pistons disposed within the cylinders of the first cylinder group toward a bottom-dead-center position and drives pistons disposed within the cylinders of the second cylinder group toward a top-dead-center position, with the gas pressure within the cylinders of the second cylinder group being maintained at atmospheric air pressure as the pistons disposed within the cylinders of the second cylinder group are driven toward the top-dead-center position.

* * * * *